United States Patent [19]

Cooke

[11] Patent Number: 4,662,823

[45] Date of Patent: May 5, 1987

[54] AIR TURBULENCE BLADES FOR CEILING FANS

[76] Inventor: Frank L. Cooke, 409 Castleton Cir., Tallahassee, Fla. 32312

[21] Appl. No.: 791,866

[22] Filed: Oct. 28, 1985

[51] Int. Cl.[4] ..... F04D 29/36

[52] U.S. Cl. ..... 416/23; 416/228; 416/235

[58] Field of Search ..... 416/5, 23, 175 C, 228, 416/236 R, 237 R, 237 A, 235

[56] References Cited

U.S. PATENT DOCUMENTS

| | | | |
|---|---|---|---|
| 871,729 | 11/1907 | McChord, Jr. | 416/207 |
| 1,055,947 | 3/1913 | Schwartzberg | 416/62 |
| 1,422,109 | 7/1922 | Lambert | 416/235 |
| 1,638,071 | 8/1927 | Travnicek | 416/237 X |
| 2,014,032 | 9/1935 | Sharpe et al. | 416/228 |
| 3,053,325 | 9/1962 | Ferreira | 416/228 |
| 3,171,495 | 3/1965 | Puckett | 416/228 |

*Primary Examiner*—Robert E. Garrett
*Assistant Examiner*—Joseph M. Pitko
*Attorney, Agent, or Firm*—Dowell & Dowell

[57] ABSTRACT

Supplemental blade attachments which are mounted to the end portions of the primary blades of conventional ceiling fans and which are of a configuration to establish a greater dispersion of air with respect to the fan by creating air turbulence which is directed radially outwardly in angular relationship with respect to the rotational axis of the fan.

20 Claims, 7 Drawing Figures

Fig. 1
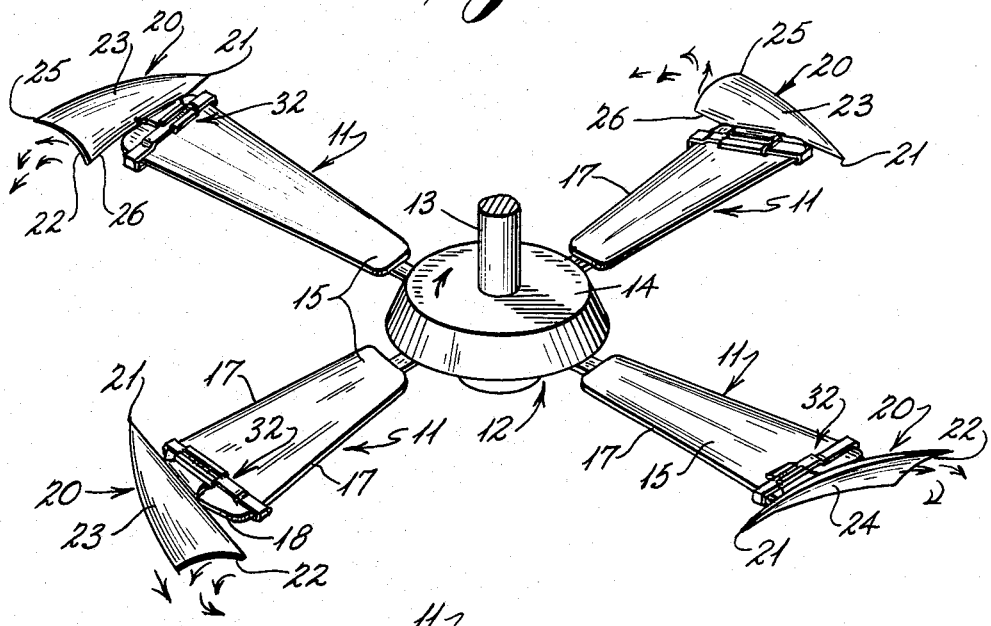
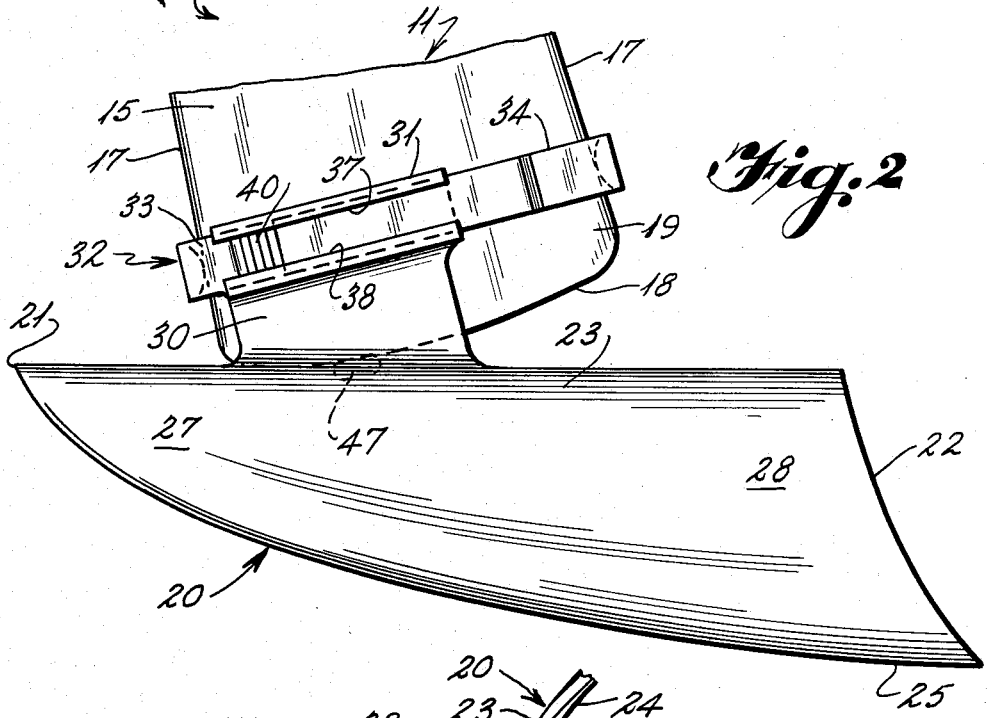
Fig. 2
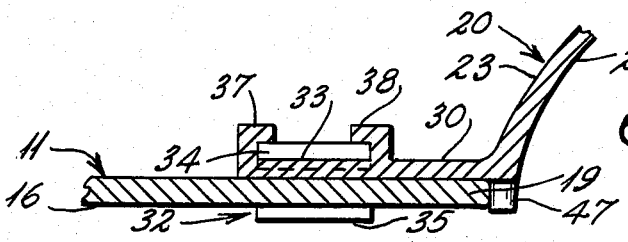
Fig. 7

AIR TURBULENCE BLADES FOR CEILING FANS

BACKGROUND OF THE INVENTION

1. Field of the Invention

This invention is generally related to rotary fans of the ceiling type which are used for creating an air flow within a room or other area and particularly to supplemental blades or blade attachments which are selectively mounted to the main or primary blades of conventional ceiling fans. The blade attachments are continuously curved along their length and are mounted to the primary fan blades in such a manner that a turbulent air flow is created in a zone which is spaced radially outwardly with respect to the normal downdraft of air created by the fan. Although the blade attachments may be integrally formed with the primary fan blades, in the preferred embodiment of the invention, the blade attachments are removably or detachably mounted to the end portions of existing ceiling fan blades by use of clamping members which are adaptable to a plurality of blade sizes and configurations.

2. History of the Invention

Conventional ceiling fans are utilized to create an air turbulence or movement of air within an enclosed area and thereby provide a more comfortable environment. The air turbulence created by such fans not only serves to circulate the air within a given enclosure or area thereby dispersing smoke, odors and the like, but also, such air movement creates a cooling effect by increasing the convective heat exchange rate with respect to people within the areas. Because of the foregoing benefits and as ceiling fans are quiet and inexpensive to operate, there has been a recent increase in the demand for such products either as alternatives for high cost refrigerated air conditioning or as supplements thereto.

Ceiling fans normally have rather large blades which are mounted to a motor so as to be rotated in a horizontal plane at relatively low revolutions per minute. As the fan blades are rotated, a downdraft of air is created with the air above the blades being forced downwardly toward the floor of a room or enclosure. A flow or pattern of air movement is created by the fans which may be considered somewhat toroidal in configuration or circular in cross section. Such a flow, therefore, creates or leaves zones of air which are not subjected to the air turbulence. Such air zones or pockets of non-turbulent air are generally located in spaces which are oriented radially outwardly with respect to the column or downdraft of air which is created by the rotation of the fans. Further, although the pitch of the fan blades may be varied or changed, such modifications have not been totally satisfactory in creating increased air dispensing nor are such solutions to increasing air turbulence applicable to existing fan structures.

In the past, there have been a number of attachments designed for use with electric fan blades and blades for ceiling fans. In U.S. Pat. No. 871,729 to McChord, Jr., one type of supplemental ceiling fan blade attachment is suggested as being adjustably mounted to the ends of the ceiling fan blades. The supplemental blades, however, are relatively large and rectangular in configuration thereby providing or creating a large air resisting surface which would not only place an undesirable load on the fan motor but which would create noise as the supplemental blades are rotated. Further, the supplemental blades are mounted or attached to the main blades by bulky adjustable clamps which would require that each supplemental blade be perfectly adjusted in a like manner with respect to the fan blades in order not to adversely effect the rotational balance of the fan. Such a structure, therefore, would not provide for a balanced load on a fan and would not insure that turbulent air is created in the areas which are angularly offset from the downdraft space without the creation of unacceptably large resistances to the rotation of the fan and by creating increased loads and vibratory stresses.

SUMMARY OF THE INVENTION

This invention is directed to supplemental blades or blade attachments which are selectively mounted to the blades of conventional ceiling fans so as to create a more diverse flow of turbulent air therefrom. The blade attachments include a relatively short supplemental blade element which is continuously curved along its length in such a manner that the radius of curvation decreases from the leading end to the trailing end thereof. The underside of the supplemental blade element is somewhat concave from one side thereof to the other. A mounting strut or flange extends from the blade to a mounting clamp carried adjacent the outer end thereof. The mounting clamp is adjustable and includes a pair of locking bands which are selectively engageable with the sides of a conventional ceiling fan blade. A fan blade alignment pin extends from the mounting strut adjacent the blade element and functions as an abutment surface or guide to insure that the supplemental blade element is properly positioned adjacent the outer end or tip of the fan blades. When positioned on a fan blade, the leading edge or end of the supplemental blade element extends forwardly of the tip of the blade and in general alignment with the arc defined by the tip of the blade as the blade is rotated. The trailing or rear end of the supplemental blade extends outwardly at an angle with respect to the tip of the blade so that as the supplemental blade passes through the air, the air passing therefrom will be caused to swirl creating vortexes of turbulent air which are directed outwardly at angles of between approximately 30 to 60 degrees with respect to the axis of rotation of the ceiling fan.

It is the primary object of this invention to provide a blade attachment which can be easily mounted on the tips of conventional ceiling fan blades in order to create a more diverse flow of air therefrom and particularly a more turbulent flow of air in those air zones which are spaced outwardly in an angular relationship to the normal downdraft of air created by a conventional ceiling fan.

It is also an object of the present invention to provide attachments for ceiling fans which will cause a greater turbulent air flow as the fans are rotated without significantly increasing the operational noise level of the fans.

It is a further object of the present invention to provide blade attachments for ceiling fans which are designed to create uniform turbulent airflow therefrom so that the rotational movement of the fans remains in balance.

It is yet another object of the present invention to provide supplemental blades for ceiling fans which may be selectively mounted to a number of sizes and styles of conventional fan blades utilizing adjustable clamping members which become more tightly secured by centrifugal force as the blades are rotated.

It is also an object of the present invention to provide blade attachments which are utilized to increase the field or zone of air turbulence created by conventional ceiling fans and which include clamping and alignment members for insuring that each blade attachment is mounted in proper relationship to the blades of the ceiling fans.

Another object of the present invention is to provide an aerodynamic design for an outer blade element of a ceiling fan blade so as to create air flow angularly outwardly with respect to the normal downdraft or flow created by the main portion of the fan blades and wherein such outer blade element may be either integrally formed with or removably attached to the main portion of the fan blade.

BRIEF DESCRIPTION OF THE DRAWINGS

FIG. 1 is a perspective view illustrating the fan blade attachments of the present invention as they are selectively mounted to an existing conventional ceiling fan.

FIG. 2 is a top plan view of a fan blade attachment of FIG. 1 showing the mounting relationship of the attachment with respect to the blade of the ceiling fan.

FIG. 7 is an enlarged cross sectional view taken along lines 7—7 of FIG. 5.

DESCRIPTION OF THE PREFERRED EMBODIMENT

Figure 3:
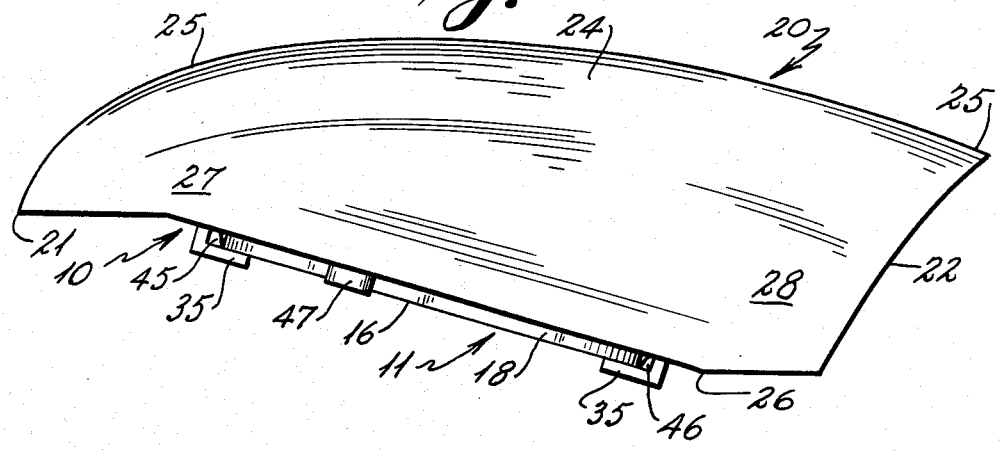
FIG. 3 is a front plan view of the fan blade attachment shown in FIG. 2.
Figure 4:
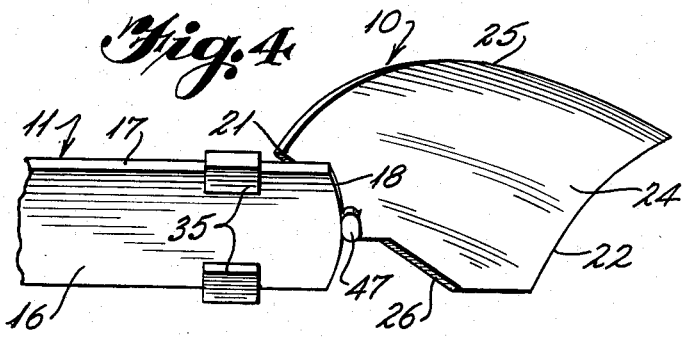
FIG. 4 is a bottom plan view of the fan blade attachment shown in FIG. 2.

With continued reference to the drawings, the fan blade attachments 10 of the present invention are shown in FIG. 1 as being mounted to the blades 11 of a conventional ceiling fan 12. The ceiling fan is generally suspended from a ceiling or other overhead structure (not shown) by a support shaft 13 which extends upwardly from a motor housing 14. The fan blades 11 are rotated in a horizontal plane and are shown in the drawings as being movable in a clockwise direction.

Each fan blade 11 has an upper and lower surface 15 and 16, side edges 17, outermost edge 18, and tip portion 19. The fan blades are shown as being relatively planar in configuration, however, in some instances, the blades may be pitched or slightly curved to create differing air flow patterns.

The fan blade attachments 10 are formed of a plastic or metallic material and have a curved blade element 20 which extends from a forward end or tip 21 to a rear or trailing edge 22. The upper surface 23 of the blade elements is somewhat convex in configuration and the lower surface 24 is somewhat concave in configuration.

The blade elements are shaped so as to pass or move through the air in such a manner as to create a minimum resistance to the movement of the fan blades. The blade elements include an outer arcuate edge 25 which extends from the tip 21 to the trailing edge 22 thereof. The inner edge 26 which also extends between the tip of the blade elements to the trailing edge thereof is shown as having a somewhat straight line configuration. When mounted in position on a fan blade, the outer edge 25 will be positioned outwardly from and at a greater elevation than the lower edge 26.

As previously mentioned, the underside or lower surface 24 of the blade elements is concave with the radius defining the concavity between the inner and outer side edges 26 and 5, respectively, being decreased between the forward or leading edge portions 27 of the blade and the rear or trailing edge portions 28 thereof. Thus, the areas adjacent the leading edge portion 27 of the blade elements is smaller in cross section and is defined having a first radius of curvature. The trailing edge portions 28 of the blade elements is somewhat larger and is defined by a cross section having a radius of curvature which is less than the radius of curvature defining the cross section of the leading or front edge portions of the blade elements. The design of the blade elements not only reduces the resistance created by the fan blades but also allows the blades to move quietly through the air. Further, the curvilinear shape of the blade elements causes a vortex of air flow to be created as the blade elements are rotated by the ceiling fan blades. This movement of air is shown somewhat by the arrows in Fig. 1.

The blade elements 20 are shown as being mounted to the end portions 19 of the fan blade 11 by way of a flange or strut member 30 which extends outwardly from adjacent the inner edge 26 of the blade elements. The mounting flange 30 has an outer generally U-shaped member 31 formed therein which forms one portion of a clamping assembly which is used for locking the blade elements 20 to the fan blades 11.

Figure 5:
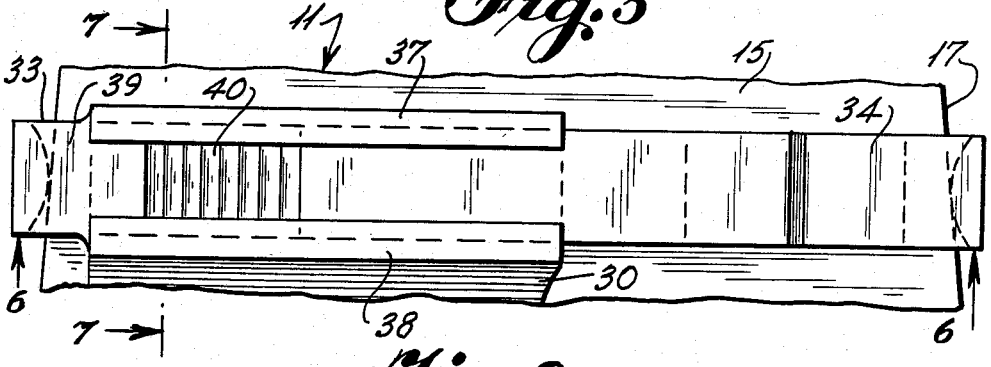
FIG. 5 is a partial top plan view showing the fan blade attachment clamp of the present invention.
Figure 6:
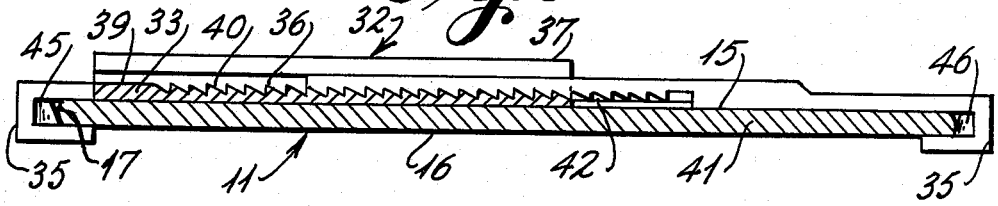
FIG. 6 is a cross sectional view taken along lines 6—6 of FIG. 5.

With specific reference to FIGS. 5, 6 and 7, the clamping assembly 32 includes the generally U-shaped portion 31 of the mounting flange 30 and a pair of outwardly extending arm members 33 and 34. The arm members are relatively adjustable in overlying relationship with one another and each arm includes an outer hooked end 35 which is engageable over one of the edges 17 of the fan blades. As shown, arm member 33 is integrally formed with the U-shaped member 31 of the mounting flange 30, however, such member could be formed as a separate element. The U-shaped portion 31 of the mounting flange 30 includes an open channel 36 defined on each side by L-shaped guide members 37 and 38. The guide members are made somewhat yieldable or flexible for purposes which will be described in greater detail hereinafter. A length of the upper surface 39 of the arm member 33 is coextensive with the L-shaped guide members and includes a plurality of spaced ratchet teeth 40 which are formed therein.

The second arm member 34 has a portion of the lower surface 41 thereof formed to provide a series of spaced ratchet teeth 42 which are interlockable with the ratchet teeth 40 of the arm member 33.

The open channel 36 is of a size to permit the interlocked ratchet portions of arm members 33 and 34 to be contained therein with any relative movement between the arms being resisted by the flexible L-shaped guides 37 and 38. In this manner, as the separate locking arm 34 is urged toward locking arm 33, the guides 37 and 38 will flex or yield slightly to permit the ratchet teeth to slide relative to one another in a closing direction. The shape of the ratchet teeth will thereafter prevent the locking arms from being withdrawn from an interlocking engagement.

The blade engaging hooked ends 35 of the clamping arms 33 and 34 include rounded or beveled engaging contacts 45 and 46 which will insure that the edges 17 of the fan blades 11 are tightly wedged therein regardless of any differences that may exist in the edges of the blades. Also, the rounded engaging contacts will bind the clamping members even more tightly to the fan blades by centrifugal force as the fan blades are rotated.

The clamping assembly 32 is properly aligned with the end portions 19 of the fan blade by way of an integrally formed pin or knob 47 which extends downwardly from the mounting flange 30 adjacent the inner edge 26 of the blade element 20. The knob 47 is positioned so as to engage the outermost edge of the end portion 19 of the fan blades 11, thereby properly positioning the blade elements 20 and clamping assembly 32 with respect thereto.

The locator knob and clamping assembly are designed to insure that the blade elements 20 are properly aligned with the fan blades in order to create a turbulent air flow which is outwardly and upwardly with respect to the normal downdraft or flow of air with respect to the fan blades 11. Preferrably, the leading portion or tip 21 of blade elements 20 is generally aligned close to the arc or circle defined by the movement of the end portion of the fan blades. As shown in FIG. 2, the tip of the blade elements somewhat overlap an imaginary circle defined by the direction of travel of the fan blades and extends forwardly of the leading edge 17 of the fan blade in the direction of rotation thereof. The trailing edge 22 of the blade elements extends outwardly away from the circle defined by the rotation of the fan blades at an acute angle thereto. The angle shown is approximately 25° although this angle could vary but should not exceed approximately 35° to 40°. In addition, the blades are of a weight and size to be compatable with existing ceiling fans so as not to create loads or air resistances which would be detrimental to the safe operation of the fans. Generally, the blade elements should be of a length as measured between the leading tip or end 21 and the rear edge 22 thereof which is equal to approximately one and one-half to three times the width of the fan blades as measured at their widest points between edges 17. The width of the blade elements between the edges 25 and 26 will also vary with the maximum width being adjacent the rear edge as previously explained with regard to the variation in radius of curvation of the blade elements between the front end and rear edge thereof. Preferrably, such maximum width should be approximately equal to one-third to two thirds of the length of the blade elements. When mounted to a fan blade, the outer edge 25 of the blade element will extend upwardly at an angle of between approximatley 20° to 45° from the vertical line.

Although not specifically shown in the drawings, the blade elements 20 of the present invention could be affixed to the fan blades by some other clamping or locking mechanism or could be permanently formed thereto or mounted thereto.

In use, the blade attachments 10 of the present invention are selectively mounted to at least two diametrically opposed blades 11 of a ceiling fan. In the event the ceiling fan does not have two diametrically opposed blades, then a blade attachment should be provided for each blade so as to insure a proper balancing of the ceiling fan during operation. The blade elements 20 are properly aligned with the fan blades 11 by urging the locator knob 47 against the outermost ends of the fan blades. Thereafter, the overlapping clamping member arm 34 is urged toward the opposite clamping member arm 33 until the hooked ends 35 of the arms are tightly engaged with the edges 17 of the fan blades. The guide elements 37 and 38 of the mounting member will yield as the ratchet teeth of both arm members pass beyond one another and will thereafter continuously urge such members into engagement.

After the blade attachments are secured in place and as the fan blades are rotated, the blade elements will create a spinning vortex of air flow from the trailing ends thereof. The air flow from the blade elements will direct turbulent air into a zone which is spaced outwardly with respect to the rotational axis of the fan thereby creating a wider dispension of air than would otherwise be possible.

I claim:

1. An air turbulence creating attachment for use with fan blades of conventional ceiling fans which are mounted to rotate about an axis and wherein such fan blades include side edges which define the width of the blades and a tip portion having an outermost edge comprising a curvilinear blade element for directing a flow of air outwardly in angular relationship with respect to the rotational axis of the ceiling fan, said curvilinear blade element having upper and lower surfaces, side edge portions and front and rear ends, said lower surface of said blade element being generally concave and having a first radius of curvation adjacent said front end thereof and a second radius of curvation adjacent said rear end thereof, said second radius of curvature being less than said first radius of curvation, and mounting means for securing said blade element to said tip portion of the fan blade so that said blade element extends generally transversely with respect to the elongated axis of the fan blade and outwardly and upwardly with respect to the outermost edge thereof.

2. The air turbulence creating attachment of claim 1 in which one of said side portions of said blade element is positioned adjacent the tip portion of the fan blade and the other of said side portions is spaced outwardly with respect thereto, said other of said side portions being vertically spaced in elevated relationship with respect to said one of said side portions.

3. The air turbulence creating attachment of claim 2 in which said other edge portion extends upwardly and outwardly from said front end at an angle of approximately between 20° to 45° with respect to the vertical plane.

4. The air turbulence creating attachment of claim 2 in which said blade element has a length of approximately 1.5 to 3.0 times the width of the fan blade.

5. The air turbulence creating attachment of claim 1 in which said front end of said blade element extends forwardly of one of the edges of the fan blade and is oriented substantially in alignment with a circle defined by the rotation of the outermost edge of the fan blades and said rear end extends outwardly at an angle with respect to the circle defined by the rotation of the outermost edge of the fan blades.

6. The air turbulence creating attachment of claim 1 in which said mounting means includes a clamping member for engaging the sides of the fan blade, said clamping member being connected to said blade element by a flange member which extends outwardly from one of said side edge portions of said blade element.

7. The air turbulence creating attachment of claim 6 in which said side portion of said blade element remote from said flange is in elevated relationship to said one of said side edge portions of said blade element.

8. The air turbulence creating attachment of claim 7 in which said clamping member includes a pair of outwardly extending arm portions having generally U-shaped fan blade engaging members at the outermost ends thereof, said arm portions being in slideable relationship with respect to one another, and locking means for securing said arm portions in adjusted position with respect to one another.

9. The air turbulence creating attachment of claim 8 in which said locking means includes a plurality of ratchet means carried by each of said arm portions which permit sliding motion of said arm portions toward one another but interlock to prevent the separation thereof.

10. The air turbulence creating attachment of claim 9 in which one of said arm portions includes a pair of elongate flange means which extends in spaced relationship overlying said ratchet means, said flange means being spaced so as to permit the other of said arm portions to be passed between said flange means and said ratchet means of said one of said arm portions.

11. The air turbulence creating attachment of claim 10 in which said one of said arm portions is integrally formed with said flange member.

12. The air turbulence creating attachment of claim 8 in which said outer U-shaped blade engaging members include contact means for wedging the edges of the fan blade therein.

13. The air turbulence creating attachment of claim 1 in which said mounting means includes an abutment member depending from adjacent said blade element for aligning said blade element with the fan blade, said abutment member engaging the outermost edge of the fan blade when the mounting means is in engagement therewith.

14. The air turbulence creating attachment of claim 13 in which said mounting means includes a flange member which extends outwardly from one of said side edge portions of said blade element and clamping means carried by said flange member for engaging the fan blade, said abutment member depending from said flange member.

15. In a celing fan having a motor which rotates a plurality of fan blades about a rotational axis to create a generally vertical flow of air wherein each blade includes side edges which extend outwardly on either side of the elongated axis of the blade and which define the width of the blade and which blade also has a tip portion having an outward edge, the improvement comprising at least two curvilinear blade elements for directing a flow of air outwardly in angular relationship with respect to the rotational axis of the ceiling fan, said curvilinear blade elements having upper and lower surfaces, inner and outer side edges and front and rear ends, said blade elements being carried by the tip portions of at least two of the fan blades and extending outwardly therefrom, said inner and outer side edges of said blade elements extending transversely with respect to the elongated axis of said fan blades with said inner side edge being adjacent the tip portion of the blades, said upper surface of said blade elements being slightly convex in configuration, said lower surface being slightly concave in configuration and flaring outwardly along the length of said blade elements between said front and rear ends thereof so that said blade elements are wider between said side edges adjacent the rear end thereof, whereby air passing below the blade elements is directed in a swirling motion outwardly from the ceiling fan.

16. The ceiling fan of claim 15 in which said outer edge of said blade elements is vertically elevated with respect to said inner edge thereof and said rear end thereof is oriented outwardly with respect to the fan blades.

17. The ceiling fan of claim 16 in which said blade elements are of a length between said front and rear ends thereof which is approximately one and one half to three times the maximum width of the fan blades.

18. An air turbulence attachment for use with the fan blades of conventional ceiling fans which are rotated about an axis and wherein such fan blades include side edges which define the width of the fan blades and a tip portion having an outermost edge comprising a curvilinear blade element for directing a flow of air outwardly in angular relationship with respect to the rotational axis of the ceiling fan, said curvilinear blade element having upper and lower surfaces, inner and outer side edge portions and front and rear ends, said upper surface of said blade element being slightly convex in configuration, said lower surface of said blade element being slightly concave in configuration and flaring outwardly along the length of said blade element from said front end to said rear end thereof, said inner and outer edges of said blade element converging toward one another toward said front end of said blade element with said outer edge being in vertically elevated relationship with respect to said inner edge thereof along at least a portion of the length thereof, and mounting means for securing said blade element to the tip portion of the fan blade so that said blade element extends generally transversely with respect to the elongated axis of the fan blade.

19. The air turbulence creating attachment of claim 18 incuding locator means extending from said mounting means adjacent said blade element for engaging the outer edge portion of the fan blade when said blade element is properly aligned therewith.

20. The air turbulence creating attachment of claim 18 in which said blade element is of a length between said front and rear ends which is approximately one and one half to three times the width of the fan blades.

* * * * *